United States Patent [19]

Morton

[11] 4,319,314

[45] Mar. 9, 1982

[54] LIGHT FIXTURE WITH INTERNAL CONNECTION ZONE

[75] Inventor: James F. Morton, Milwaukee, Wis.

[73] Assignee: Phoenix Products Company, Inc., Milwaukee, Wis.

[21] Appl. No.: 149,235

[22] Filed: May 12, 1980

[51] Int. Cl.[3] ..... F21S 1/02

[52] U.S. Cl. ..... 362/432; 362/147; 362/269; 362/427

[58] Field of Search ..... 362/147, 269, 432, 427

[56] References Cited

U.S. PATENT DOCUMENTS 4,001,571 1/1977 Martin ..... 362/147

*Primary Examiner*—Stephen J. Lechert, Jr.

*Attorney, Agent, or Firm*—Quarles & Brady

[57] ABSTRACT

An electrical light fixture (1) having a tubular arm (2) with an opening (20) formed in a wall portion to define a connecting zone (21) in which internal lamp wiring (13) is connected to an external power supply line (25) which extends through a cover (23) for the opening.

3 Claims, 4 Drawing Figures

LIGHT FIXTURE WITH INTERNAL CONNECTION ZONE

TECHNICAL FIELD

This invention relates to a light fixture of the type having a tubular arm with a light supported near one end of the arm, such as are utilized in industrial applications for lighting railroad or truck loading docks.

BACKGROUND ART

Industrial light fixtures including a tubular arm, such as an arm made of one or more square channel elements, with one end of the arm attached on a suitable mounting bracket, an electrical lamp at the other end of the arm, and wiring enclosed within the tubular arm and leading to the lamp must be connected to an electrical power supply line when they are installed in the desired area. The typical prior art system for connecting the power supply line to the internal lamp wiring of the light fixture has been to attach a junction box to an external surface of the arm and make the connection between the power supply line and the internal lamp wiring in the junction box.

DISCLOSURE OF INVENTION

My present invention relates to a light fixture of the type having a tubular arm wherein an opening is formed in a selected portion of the arm to provide a connecting zone inside the arm, a cover plate is applied over the opening, in the arm, and the connection between the power line and the internal lamp wiring of the light fixture is made within the connecting zone underneath the opening. This construction eliminates the need to use an external junction box on top of the arm and yet provides a safe and neat system for making the required connection.

BEST MODE FOR CARRYING OUT THE INVENTION

Figure 1:
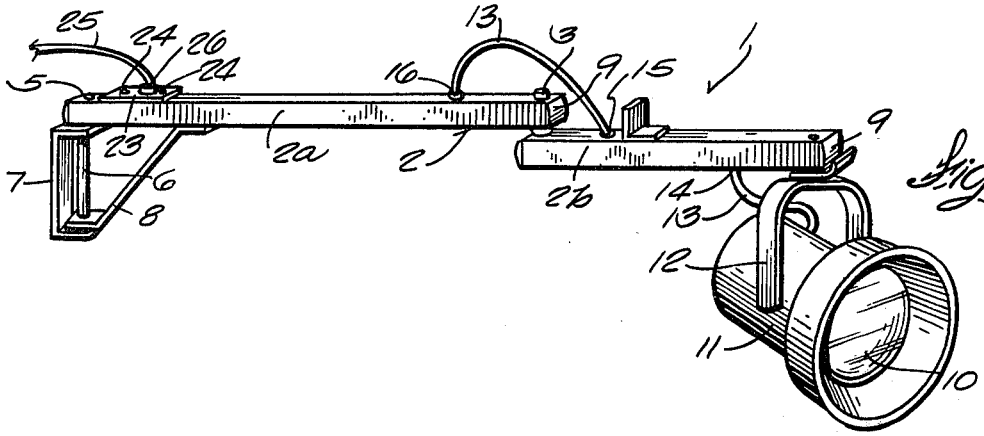
FIG. 1 is a perspective view of a light fixture incorporating the present invention.

FIG. 1 illustrates an industrial electrical light fixture 1 having a tubular arm 2 comprising an inner section 2*a* and an outer section 2*b* pivotally connected together about a pivot pin 3. The tubular arm 2 may have only one section or more than two sections, and the connection between sections 2*a* and 2*b* may be a swivel type connection if desired. The arm 2 is shown as being made of four-walled metal channel sections, which can be square or rectangular in cross-section; also, the tubular arm can have an oval or circular cross-section. The inboard end of arm section 2*a* is pivotally supported about a pin 5 (see also FIG. 2) that extends through a pivot tube 6 supported in a bracket 7. The bracket 7 is adapted to mount the light fixture 1 on a wall or other suitable surface. Brace 8 may extend from the lower end of the bracket to the underside of the arm section 2*a* as shown. End caps 9 close each end of the arm sections 2*a* and 2*b*.

At the other end of the arm 2, an electric light 10 is supported in a lamp housing 11 carried in U-shaped bracket 12 that is secured near the outer end of arm section 2*b*. Lamp wiring 13 is connected to the lamp 10, led into sthe arm section 2*b* at 14 and strung inside the arm to exit at 15, and then led into arm section 2*a* at 16 and strung inside the arm section 2*a* towards its inboard end. Thus, at least part of the lamp wiring 13 is arranged internally of the tubular arm 2. The internal lamp wiring 13 is typically three conductor electrical wire to provide a grounded cord. Suitable strain connectors are employed at the points 14-16 where the internal lamp wiring passes through a wall of the arm sections 2*a* and 2*b* in accordance with the usual practice.

The light fixture 1 as described to this point is of a typical construction which has been sold in large numbers by the assignee of this application. The present invention relates to the manner in which the internal lamp wiring 13 is connected to an electrical power supply line.

Figure 2:
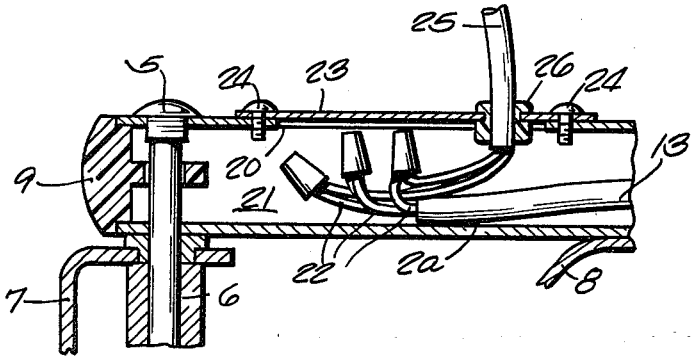
FIG. 2 is a vertical sectional view of a portion of the light fixture.
Figure 3:
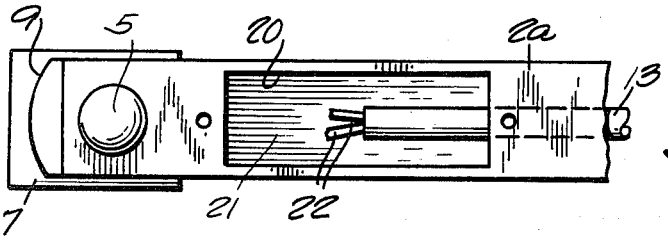
FIG. 3 is a top view of a portion of the light fixture illustrating the opening formed in the tubular arm of the fixture.

Turning now to FIG. 3, an opening 20 is formed in the top wall of the arm section 2*a* near the inner end thereof attached to the bracket 7. The interior of the arm section underneath the opening forms a connecting zone 21 which will be utilized to make the connections with a power supply line as described hereinafter. The internal lamp wiring 13 has conductor ends 22 disposed within the connecting zone 21 as shown in the drawing. A cover 23 (see FIGS. 1 and 2), illustrated as comprising a flat plate, is provided which is large enough to cover the opening 20 and has end portions extending beyond the opening through which fastening means such as self-tapping screws 24 extend to attach the cover to the top wall of the arm section. Electrical power supply line 25, illustrated herein as a three-wire conductor, passes through the cover 23, with a suitable strain connector 26 being inserted therebetween. The power supply line 25 is connected to the ends 22 of the internal lamp wiring 13 within the connecting zone 21 underneath the opening 20 in the usual manner as illustrated in FIG. 2.

PRIOR ART

Figure 4:
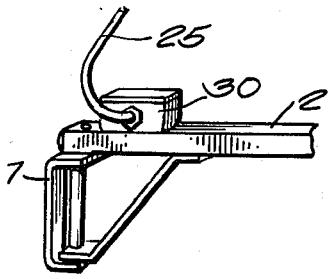
Fig. 4 PRIOR ART
FIG. 4 is a perspective view similar to FIG. 1 except with a portion of the light fixture broken away illustrating a prior art system for making the connection between the power supply line and the internal wiring of the light fixture.

FIG. 4 illustrates a prior art manner in which the connection between an electrical power supply line and internal lamp wiring has been made. An external junction box 30 is attached to one end of the arm 2 of a light fixture, near the bracket 7. The supply line 25 is led into the junction box 30 through a side wall thereof, and the internal lamp wiring 13 is led through the bottom of the box so that the connections between the two are made inside the junction box. The prior art approach thus required the use of an extra accessory, i.e. the junction box 30, and made the connections externally of the arm of the lamp fixture.

In contrast to the prior art system, the present invention provides an internal connecting zone inside the tubular arm of a light fixture within which the connections are made between an electrical power supply line and the internal lamp wiring leading to the lamp element. This is accomplished by providing an opening in the wall of the tubular arm and a cover for the opening, and then leading the supply line through the cover to be connected to the internal lamp wiring within the zone defined by the opening. This provides an especially neat arrangement and eliminates the need for an external junction box as has been typically used before. At the same time, easy access is provided so that the requisite electrical connections can be made in a convenient manner. Also, there is less danger of accidental damage to the power line connection since it is made internally of the arm of the fixture rather than in an exposed exterior junction box. Prior art fixtures using a junction box have the power supply line leading through a side of the box, thereby forming a rather large loop of wire along one side of the light fixture which can sometimes be a problem. This is avoided with the present invention by forming the opening in the top wall of the tubular arm as shown in the drawings, which keeps the power supply line above the fixture instead of on one side of it; this new arrangement minimizes the potential for interference between the fixture and a loop of the supply line.

I claim:

1. In an electrical light fixture of the type including a tubular arm, an electric light supported on the arm, and lamp wiring connected to the electric light and being at least partly arranged internally of the tubular arm, the improvement comprising:

an opening formed in the tubular arm to define thereunder a connecting zone within the arm;

the lamp wiring having conductor ends disposed within the connecting zone;

a cover attached to the tubular arm over the opening; and an electrical power supply line extending through the cover and connected to the conductor ends of the lamp wiring in the connecting zone within the arm.

2. The electrical light fixture of claim 1 wherein:

the tubular arm is a four-walled channel element, the opening is formed in one wall of the channel element, the cover is a flat plate having end portions extending beyond the opening, and fastening means extend through the end portions to attach the plate to said one wall of the channel element.

3. An electrical light fixture according to claim 1 or 2 wherein:

the opening is formed in a top wall of the tubular arm.

* * * * *